US009953772B2

(12) United States Patent
Korves et al.

(10) Patent No.: US 9,953,772 B2
(45) Date of Patent: Apr. 24, 2018

(54) HIGH-VISIBILITY STATUS INDICATOR

(71) Applicant: COOPER TECHNOLOGIES COMPANY, Houston, TX (US)

(72) Inventors: Brian Andrew Korves, St. Francis, WI (US); William Robert Luoma, Franklin, WI (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 15/477,368

(22) Filed: Apr. 3, 2017

(65) Prior Publication Data

US 2017/0287653 A1 Oct. 5, 2017

Related U.S. Application Data

(60) Provisional application No. 62/318,195, filed on Apr. 4, 2016, provisional application No. 62/466,163, filed on Mar. 2, 2017.

(51) Int. Cl.

| | |
|---|---|
| ***H01H 9/16*** | (2006.01) |
| *H01H 9/02* | (2006.01) |
| *H01H 9/00* | (2006.01) |

(52) U.S. Cl.

CPC ..... *H01H 9/16* (2013.01); *H01H 9/0044* (2013.01); *H01H 9/02* (2013.01); *H01H 2009/0292* (2013.01)

(58) Field of Classification Search

CPC ..... H01H 9/16; H01H 9/0044; H01H 9/02; H01H 2009/0292

USPC ..... 116/303, 333–334, 2, DIG. 21, DIG. 28; 200/329–345; 218/152

See application file for complete search history.

(56) References Cited

U.S. PATENT DOCUMENTS 2,293,698 A * 8/1942 Chaput ..... B60T 17/22 116/303
3,225,156 A * 12/1965 Sahrbacker ..... H01H 9/26 200/291
3,646,958 A * 3/1972 Braas ..... F16K 31/52408 137/553
4,117,280 A * 9/1978 Feaster ..... H01H 23/006 200/339
4,568,804 A 2/1986 Luehring
(Continued)

OTHER PUBLICATIONS

The PCT International Search Report and Written Opinion From Corresponding Application No. PCT/US2017/025697, dated Jul. 29, 2017 (7 sheets).

*Primary Examiner* — R. A. Smith
*Assistant Examiner* — Tania Courson
(74) *Attorney, Agent, or Firm* — King & Spalding LLP

(57) ABSTRACT

A visual status indicator for an electrical apparatus is disclosed. The status indicator can be mounted within a lower cover of the electrical apparatus such that various display faces of the indicator are visible through one or more viewing windows of the lower cover. The status indicator can comprise a mounting base with protrusions and at least one wing, wherein the wing comprises at least one display face. At least one swing arm can be attached to the mounting base via the protrusions and the at least one swing arm can comprise at least one display face. The swing arm can be actuated such that either the display face on the wing or the display face on the swing arm is visible through the viewing window to indicate the status of the electrical apparatus.

20 Claims, 9 Drawing Sheets

(56) References Cited

U.S. PATENT DOCUMENTS

| | | | | |
|---|---|---|---|---|
| 5,178,187 | A | 1/1993 | Raymond, Jr. et al. | |
| 5,584,380 | A * | 12/1996 | Naitou | H01H 23/145 200/315 |
| 5,584,563 | A | 12/1996 | Stottmann | |
| 6,674,033 | B1 * | 1/2004 | Wang | H01H 13/562 200/334 |
| 7,314,021 | B2 | 1/2008 | Moninski | |
| 8,881,670 | B2 | 11/2014 | Binkley | |
| 8,973,519 | B2 | 3/2015 | Bindics et al. | |
| 2002/0092748 | A1 * | 7/2002 | Su | H01H 23/145 200/339 |
| 2011/0041755 | A1 * | 2/2011 | Hsu | H01H 9/16 116/303 |
| 2013/0036965 | A1 | 2/2013 | Bindics et al. | |

* cited by examiner

HIGH-VISIBILITY STATUS INDICATOR

RELATED APPLICATIONS

This application claims priority to U.S. Provisional Patent Application No. 62/318,195, titled "High-Visibility Status Indicator," filed on Apr. 4, 2016, and U.S. Provisional Patent Application No. 62/466,163, titled "High-Visibility Status Indicator," filed on Mar. 2, 2017. The foregoing applications are hereby incorporated herein in their entirety.

TECHNICAL FIELD

This description relates to a visual indicator for an electrical apparatus, such as a recloser.

BACKGROUND

The physical components that make or break an electrical connection within an electrical apparatus, such as a recloser, fault interrupter, circuit breaker, or any other type of current interrupter or switch, are typically not readily visible from outside of the electrical apparatus. Status indicators are used to provide an external visible indication regarding the status of components within the electrical apparatus. Status indicators known in the field are often small and difficult to see. For example, some electrical apparatus, such as reclosers, are located on overhead power distribution systems, which makes the status indicators difficult to see from the ground. Status indicators known in the prior art provide examples of the deficiencies in existing status indicators.

For example, U.S. Pat. No. 7,314,021 to Moninski describes an operation indicator for use with a device such as a circuit interrupter. The operation indicator is shown positioned at the bottom of the device which makes it susceptible to water collecting on the indicator and ice forming on the indicator in cold weather conditions. Ice accumulating on the indicator may make it difficult for a person to view the indicator and may cause the indicator to lock and not function properly.

As another example, U.S. Pat. No. 8,881,670 to Binkley describes a recloser position indicator that consists of a slidable and flexible strip of material having different colors, the different colors indicating the different states of the recloser. As with the indicator in the Moninski patent, Binkley's indicator is positioned at the bottom of the device making it susceptible to water and ice accumulation. Additionally, Binkley's indicator includes front and rear walls through which the indicator is not visible thereby creating substantial angles from which a person would not be able to read the indicator.

As yet another example, U.S. Pat. No. 8,973,519 to Bindics describes a recloser position indicator that includes a display disk which rotates to display different colors through a lens indicating the state of the recloser. As with the previously identified patents, the display indicator is located at the bottom of the recloser making it susceptible to the accumulation of water and ice. Additionally, the indicator lens in the Bindics patent includes opaque sections which can render the indicator difficult to view from certain angles.

In light of the foregoing and other limitations in the prior art, example embodiments of improved indicators are described herein.

SUMMARY

The present disclosure provides example embodiments of status indicators for electrical apparatus, such as reclosers.

The example status indicators are more readily visible from a variety of angles and distances without the shortcomings of prior solutions. In one example, a status indicator comprises a mounting base having first and second mounting base protrusions extending from a first side of the mounting base and third and fourth mounting base protrusions extending from a second side of the mounting base. The mounting base further comprises a first wing extending from a third side of the mounting base and comprising a first bottom wing display face and a second wing extending from a fourth side of the mounting base and comprising a second bottom wing display face. A clevis can be disposed in an internal cavity of the mounting base and the clevis can comprise first and second clevis protrusions extending from a first side of the clevis and third and fourth clevis protrusions extending from a second side of the clevis. The status indicator further comprises first and second swing arms, each of the first and second swing arms comprising a bottom member and two side members, the bottom member comprising a bottom swing arm display face and each of the two side members comprising a slot and an aperture. The slots on the first swing arm can be positioned on the first and fourth clevis protrusions and the apertures on the first swing arm can be positioned on the first and fourth mounting base protrusions. Similarly, the slots on the second swing arm can be positioned on the second and third clevis protrusions and the apertures on the second swing arm can be positioned on the second and third mounting base protrusions.

In another example, a status indicator for an electrical device comprises a mounting base with first and second mounting base protrusions extending from opposite sides of the mounting base and the mounting base further comprises a wing extending from one side and comprising a bottom wing display face. The status indicator further comprises a clevis disposed in the mounting base, the clevis comprising a first and second clevis protrusions extending from opposite sides of the clevis. A swing arm comprising a bottom member and two side members is attached to the first and second mounting base protrusions via an aperture on each side member and is attached to the first and second clevis protrusions via a slot on each side member.

In yet another example, a status indicator for an electrical device comprises a mounting base comprising first and second mounting base connection means extending from a first side of the mounting base and third and fourth mounting base connection means extending from a second side of the mounting base. The mounting base further comprises a first wing extending from a third side of the mounting base and comprising a first bottom wing display face and a second wing extending from a fourth side of the mounting base and comprising a second bottom wing display face. A yoke attachment means is disposed around the mounting base and comprises first, second, third, and fourth yoke connection means. First and second swing arms each comprise a two side members and a bottom member comprising a bottom swing arm display face. The first swing arm can be attached to the first and fourth mounting base connection means and the first and fourth yoke connection means. The second swing arm can be attached to the second and third mounting base connection means and the second and third yoke connection means.

These and other example embodiments will be described in the following text and accompanying figures.

DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. In the drawings, reference numerals designate like or corresponding, but not necessarily identical, elements.

DETAILED DESCRIPTION OF EXAMPLE EMBODIMENTS

Example embodiments of a status indicator with improved visibility are described herein. Example embodiments of the status indicator are described in connection with a recloser. However, embodiments of the status indicator can be used with other electrical apparatus. Embodiments of the status indicator should not be considered limited to the specific arrangements of components shown in any of the figures. Rather, these example embodiments are provided so that this disclosure will be thorough and complete, and will fully convey the scope of the status indicator to those of ordinary skill in the art.

Terms such as "first", "second", "third", and "side" are used merely to distinguish one component (or part of a component or state of a component) from another. Such terms are not meant to denote a preference or a particular orientation unless expressly stated, and are not meant to limit embodiments of the status indicator. In the following detailed description of the example embodiments, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

In certain example embodiments, status indicators may be subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards for electrical apparatus. Use of example embodiments described herein may meet (and/or allow a corresponding device to meet) such standards when required.

Figure 1:
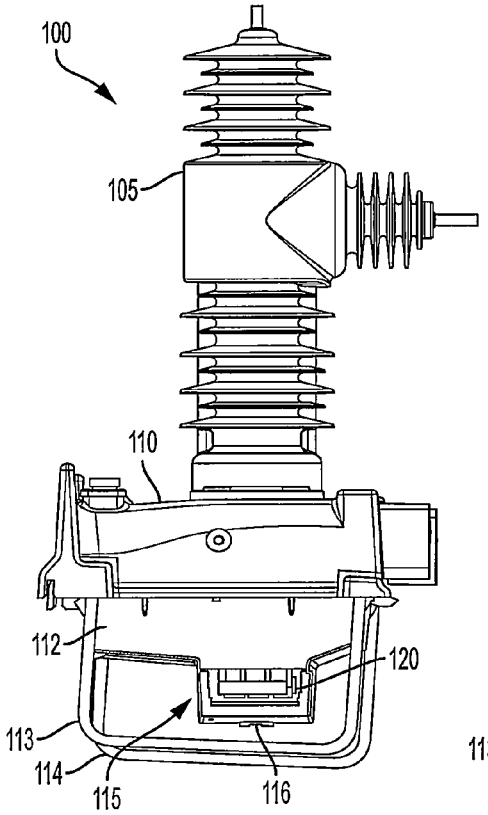
FIGS. 1 and 2 illustrate side and perspective views, respectively, of a recloser and a status indicator in accordance with example embodiments of the present disclosure.
Figure 2:
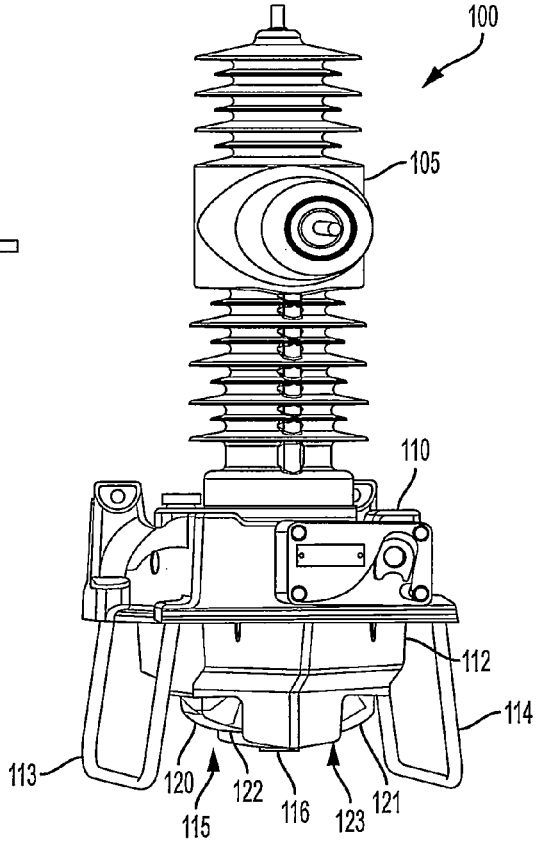
Figure 3:
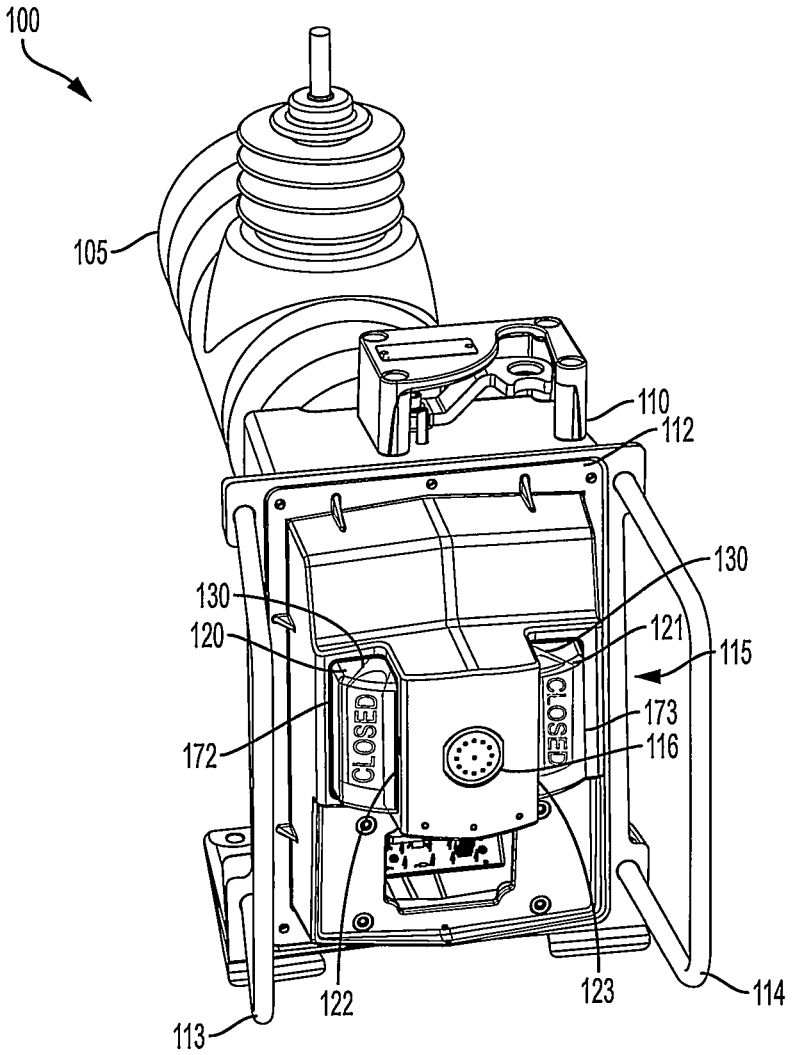
FIG. 3 illustrates a bottom perspective view of the recloser and status indicator in accordance with example embodiments of the present disclosure.

Referring now to FIGS. 1-3, a recloser assembly 100 in accordance with the example embodiments described herein is illustrated. The recloser assembly 100 comprises an interrupting module 105, a head casting 110, and a lower cover 112. A status indicator 115 is contained within the head casting 110 and the lower cover 112. Optional legs 113 and 114 can serve as a base for the recloser assembly 100 and can protect the status indicator 115. The lower cover 112 comprises a first viewing window 120 and a second viewing window 121. The status indicator 115 is visible through the first viewing window 120 and the second viewing window 121. The lower cover also comprises a drain hole 116 which comprises a plug. The drain hole 116 is positioned preferably at or near the lowest point of the lower cover so that any liquids that accumulate in the lower cover 112 will drain through the drain hole 116.

Figure 12:
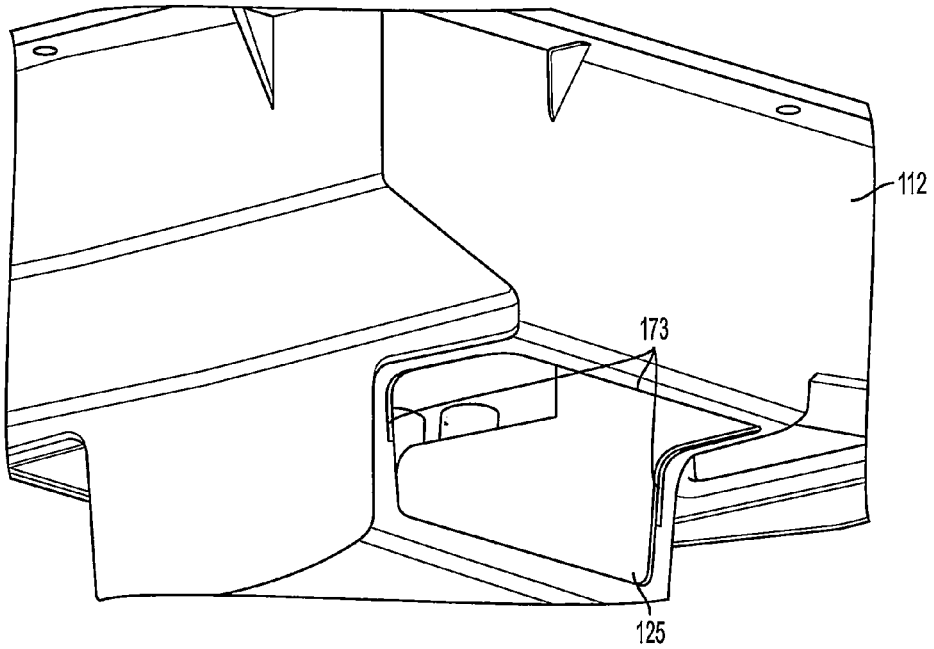
FIG. 12 illustrates an enlarged partial perspective view of a lower cover showing a drip shed in accordance with example embodiments of the present disclosure.
Figure 13:
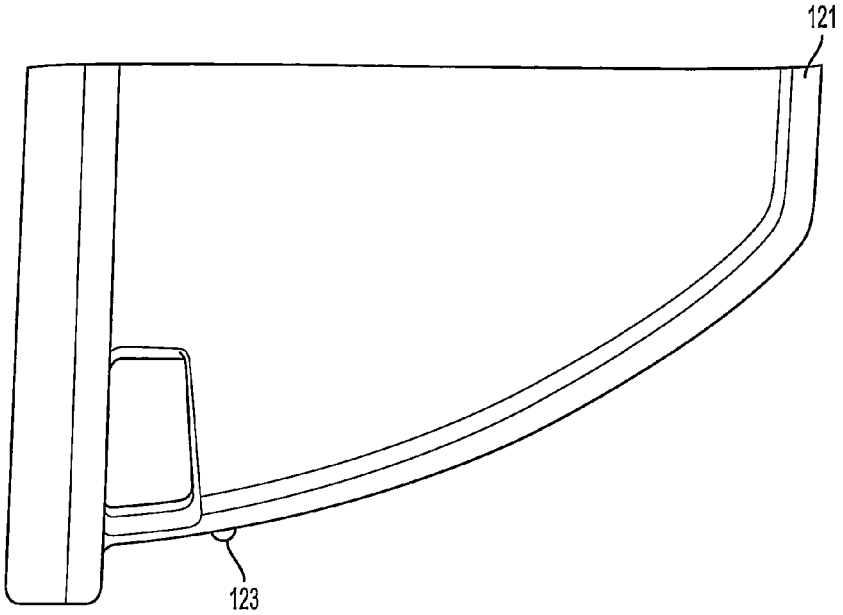
FIG. 13 illustrates an enlarged partial side view of a viewing window in accordance with example embodiments of the present disclosure.

In the example embodiment shown in FIGS. 1-3, the first and second viewing windows 120 and 121 are located on either side of the drain hole 116 and are offset vertically from the drain hole 116 so that the first and second viewing windows 120 and 121 are above the lowest point of the lower cover 112. Condensation typically tends to accumulate at the lowest point of the assembly. Condensation that accumulates in the lower portion of the apparatus can make it difficult for an observer to see the status indicator. Therefore, it is advantageous to locate the first and second viewing windows 120 and 121 so that they are offset vertically from the lowest point of the lower cover 112. The position of the first and second viewing windows 120 and 121 at the vertically offset position shown in FIGS. 1-3, which is above the drain hole 116 at the lowest point of the lower cover 112, will inhibit the accumulation of condensation on the inside of the viewing windows. Additionally, drip sheds 122 and 123 located along the outer bottom surface of viewing windows 120 and 121 redirect condensation on the outside of the lower cover 112 away from the viewing windows 120 and 121. FIG. 13 provides an enlarged partial side view of viewing window 121 and shows drip shed 123 in greater detail. Drip shed 122 on viewing window 120 can be similar to drip shed 123 shown in FIG. 13. One or more drip sheds, such as drip sheds 172 and 173, can be located on the exterior of the lower cover 112 and border one or more edges of the viewing windows 120 and 121 to inhibit the accumulation of precipitation on the outside of the viewing windows. FIG. 12 provides an enlarged partial perspective view of the lower cover 112 and illustrates in greater detail drip shed 173 along a portion of the border of aperture 125 in which viewing window 121 will be placed. Drip shed 172 on the opposite side of the lower cover 112 and along aperture 126 (shown in FIGS. 4 and 5 and referenced below) in which viewing window 120 will be placed can be similar to drip shed 173 shown in FIG. 12.

Figure 4:
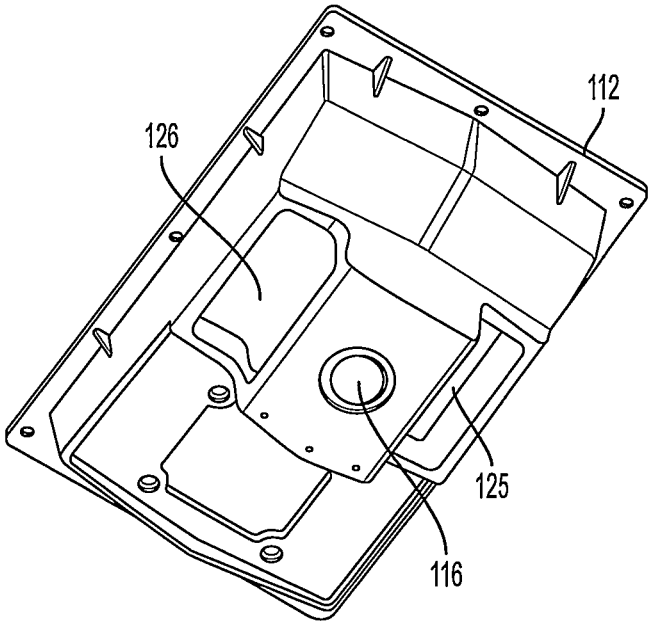
FIGS. 4 and 5 illustrate bottom and top perspective views, respectively, of a lower cover in accordance with example embodiments of the present disclosure.
Figure 5:
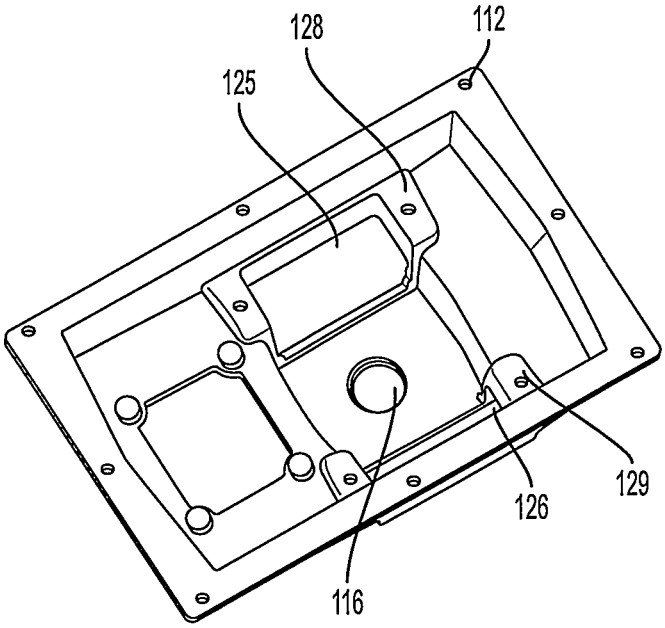

FIGS. 4 and 5 illustrate enlarged bottom and top perspective views of the example lower cover 112. The lower cover 112 includes a rim with fastener apertures for fastening the lower cover 112 to the head casting 110. The lower cover 112 also includes apertures 125 and 126 for receiving the viewing windows 120 and 121. In the example lower cover 112 illustrated in FIGS. 4 and 5, lower cover bosses 128 and 129 surround apertures 125 and 126. The lower cover bosses 128 and 129 provide a raised edge within the lower cover 112 and inhibit condensation from collecting on the inside of the viewing windows 120 and 121 that are inserted in the apertures 125 and 126. FIGS. 4 and 5 also illustrate in greater detail the drain hole 116 located at the lowest portion of the lower cover 112. The lower cover 112 is designed so that condensation within the lower cover will flow towards the drain hole 116 and away from the viewing windows 120 and 121.

Figure 6:
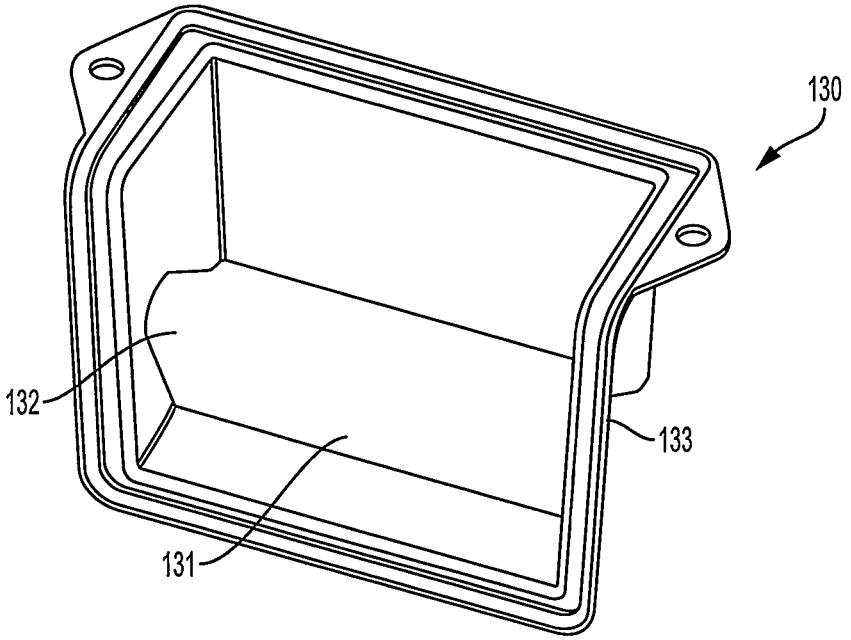
FIG. 6 illustrates a window insert in accordance with example embodiments of the present disclosure.
Figure 7:
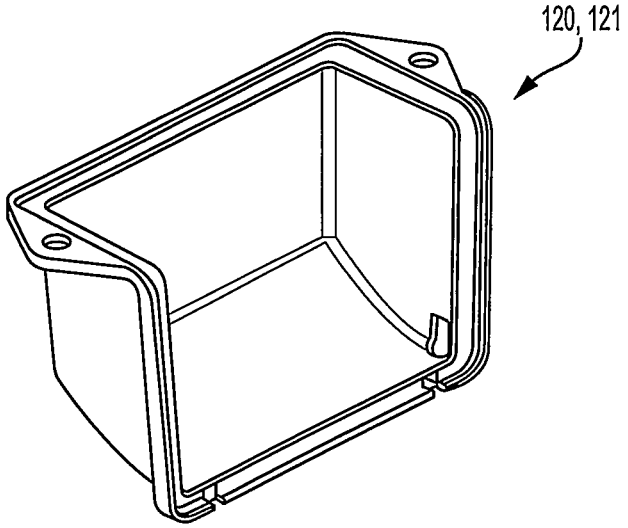
FIG. 7 illustrates a viewing window in accordance with example embodiments of the present disclosure.

FIG. 6 provides a perspective view of an example window insert 130. An example viewing window 120, 121 is illustrated in greater detail in FIG. 7. A viewing window 120, 121 can be placed in each of the apertures 125 and 126 and fastened to the lower cover bosses 128 and 129. The example viewing window 120, 121 comprises four translucent walls so that the bottom and side portions of the status indicator 115 will be visible through the viewing window. A window insert 130 can be inserted into each of the viewing windows 120, 121 and, as with the viewing windows 120, 121, the window inserts 130 can be fastened to the lower cover bosses 128 and 129. The example window insert 130 includes opaque walls, a bottom opening 131 and side openings 132 and 133. The bottom opening 131 and the side openings 132 and 133 are arranged so that bottom and side portions of the status indicator 115 will be visible through the viewing window. However, the opaque walls of the window insert 130 obstruct other portions of the status indicator so that an observer looking at the indicator will only see one indication (e.g. open or closed) at a time. For example, as shown in FIG. 3, only the portions of the indicator that indicate the closed state are visible through the bottom opening 131 and side openings 132 and 133 of the window inserts 130 within each of the viewing windows 120, 121 because the opaque walls of the window inserts 130 in each viewing window are obstructing the other portions of the indicator. Although the window insert 130 is opaque and the viewing windows 120, 121 are translucent, both components can be made of the same or a similar plastic material so that they have similar thermal expansion properties.

Figure 8:
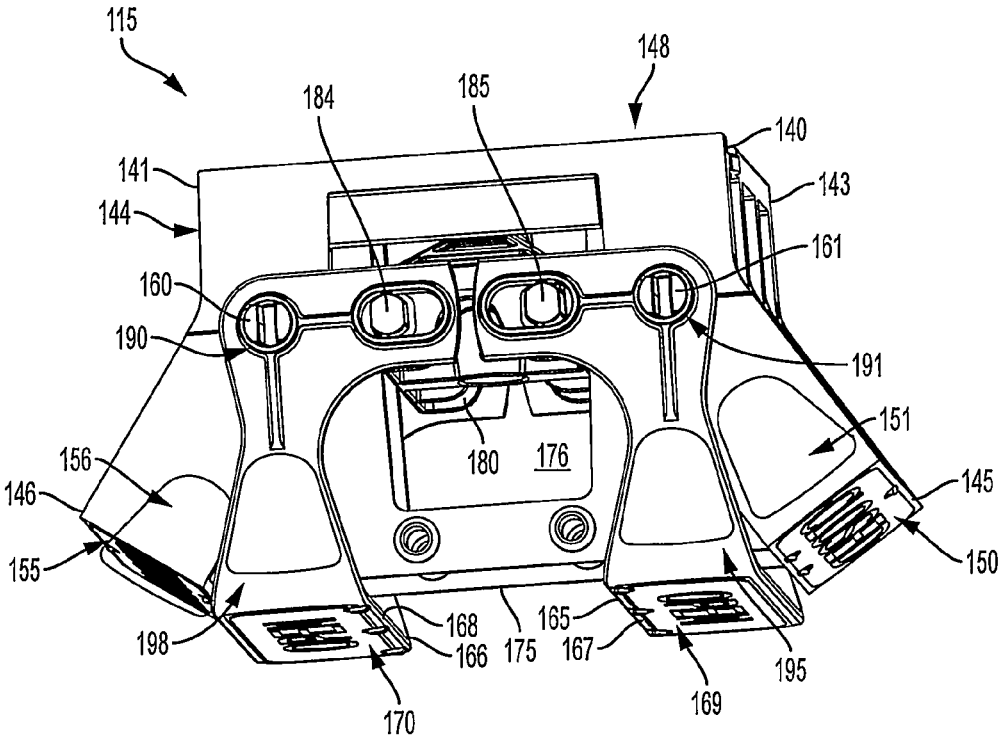
FIGS. 8 and 9 illustrate perspective views of the mounting base and swing arms of the status indicator in accordance with example embodiments of the present disclosure.
Figure 9:
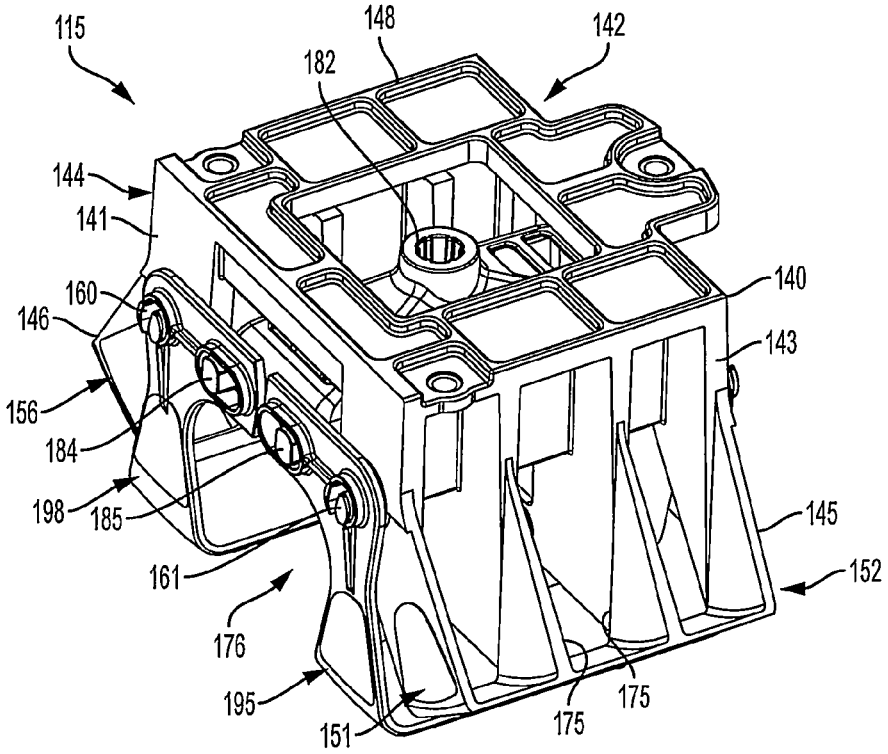
Figure 10:
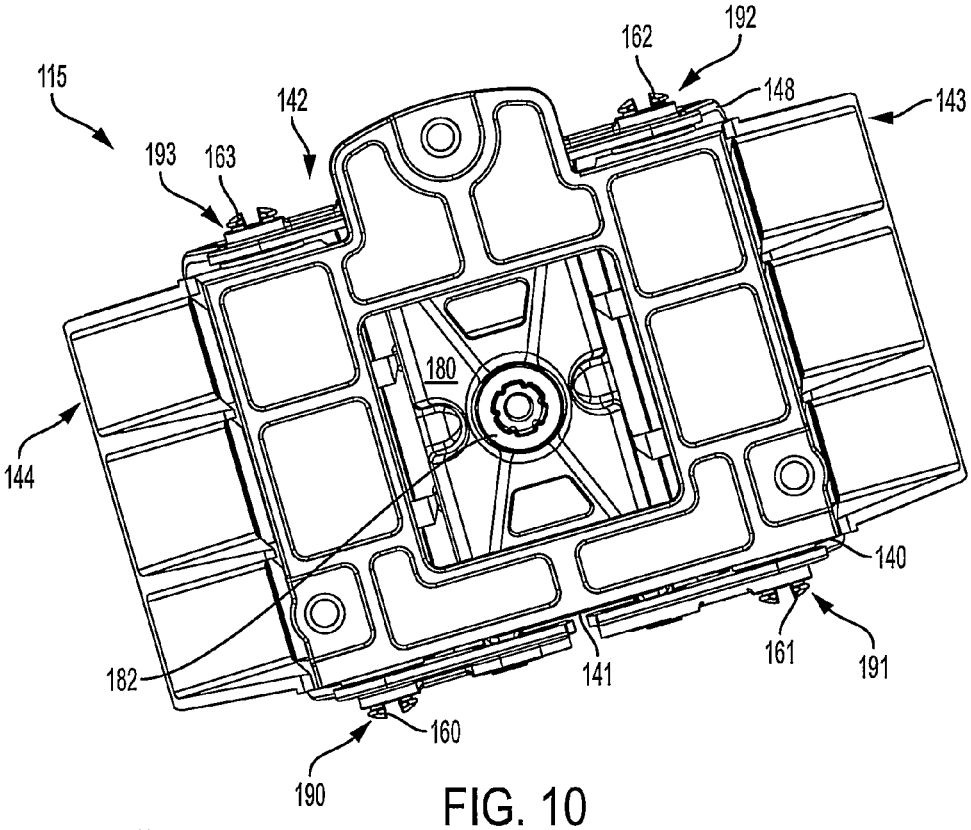
FIGS. 10 and 11 illustrate top and bottom views, respectively, of the mounting base and swing arms of the status indicator in accordance with example embodiments of the present disclosure.
Figure 11:
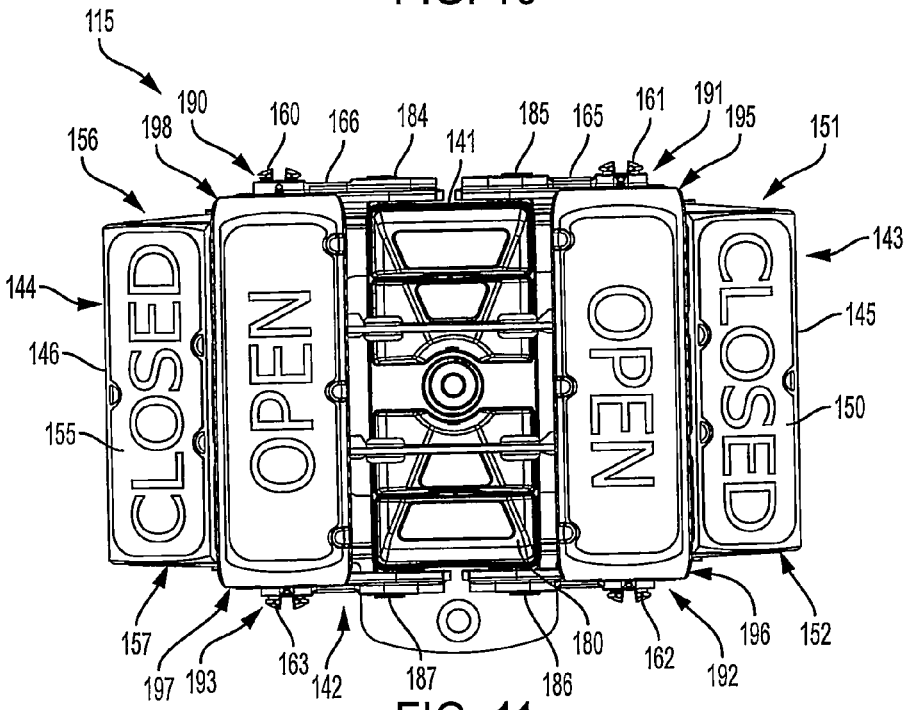

FIGS. 8 and 9 illustrate perspective views of the status indicator 115 and FIGS. 10 and 11 illustrate top and bottom views, respectively, of the status indicator 115. Referring to FIGS. 8-11 collectively, the status indicator 115 comprises a mounting base 140 with a first side 141, a second side 142, a third side 143, and a fourth side 144. The mounting base 140 further comprises a top surface 148 which fastens to an actuator of the recloser. In alternate embodiments, instead of the top surface 148 fastening directly to an actuator of the recloser, the top surface 148 may attach to lower cover 112 and be actuated indirectly by the recloser. Referring again to FIGS. 8-11, a first wing 145 extends from the third side 143 and a second wing 146 extends from the fourth side 144 of the mounting base 140. The first wing 145 comprises a first bottom wing display surface 150 and the second wing 146 comprises a second bottom wing display surface 155. The first wing 145 and the second wing 146 can also comprise first, second, third, and fourth side wing display surfaces 151, 152, 156, and 157. As shown in FIGS. 8-11, the first and second bottom wing display surfaces and the first, second, third, and fourth side wing display surfaces can comprise indicators in the form of words, symbols, and/or colors that indicate whether the apparatus, such as a recloser, is in the open or closed state. The indicators on the first and second bottom wing display surfaces as well as the first, second, third, and fourth side wing display surfaces can also include reflective material to improve visibility.

The example mounting base 140 illustrated in FIGS. 8-11 also comprises first 160, second 161, third 162, and fourth 163 mounting base protrusions extending from the first and second sides 141 and 142 of the mounting base 140. A first swing arm 165 has first swing arm apertures 191 and 192 that are mounted on the second 161 and third 162 mounting base protrusions and a second swing arm 166 has second swing arm apertures 190 and 193 that are mounted on the first 160 and fourth 163 mounting base protrusions. As illustrated in the examples in FIGS. 8-11, the mounting base protrusions 160, 161, 162 and 163 can have a substantially truncated circular shape that is substantially flat on the top and bottom with bosses on the side. The substantially truncated circular shape of the protrusions allows a person assembling the status indicator to easily slide the first and second swing arms 165 and 166 onto the protrusions, but the bosses serve to retain the swing arms on the mounting base 140 after they are installed. As can be seen in FIGS. 10 and 11, the mounting base protrusions 160, 161, 162, and 163 also have a slot that makes the protrusions more flexible and facilitates sliding the apertures 190, 191, 192, and 193 of the swing arms onto the protrusions.

The first and second swing arms 165 and 166 are preferably made of a light and flexible material such as plastic. The first and second swing arms 165 and 166 comprise respective first and second bottom members 167 and 168 which comprise first and second bottom swing arm display faces 169 and 170. The first and second swing arms 165 and 166 also comprise side members that extend from the bottom members 167 and 168 toward the apertures 190, 191, 192, and 193 that couple to the first 160, second 161, third 162, and fourth 163 protrusions. The first and second bottom swing arm display faces 169 and 170 of the first and second swing arms 165 and 166 can comprise indicators in the form of words, symbols, and/or colors that indicate whether the apparatus, such as a recloser, is in the open or closed state. Optionally, the side members of the first and second swing arms 165 and 166 can also include indicators on side swing arm display surfaces 195, 196, 197, and 198. The indicators on the side swing arm display surfaces can be in the form of words, symbols, and/or colors that indicate whether the apparatus, such as a recloser, is in the open or closed state. Including indicators on the side members of the swing arms 165 and 166 increases the range of angles from which the status indicator 115 can be read. The indicators on the first and second bottom swing arm display faces 169 and 170 as well as the side members of the first and second swing arms 165 and 166 can also include reflective material to improve visibility.

In the example illustrated in FIGS. 8-11, the bottom portion of the mounting base 140 comprises one or more guide ribs 175 which define a cavity 176 within the mounting base 140. Contained within cavity 176 is a clevis 180. The clevis 180 includes a connection feature 182 that connects to an actuator of an electrical apparatus, such as a recloser. The connection feature 182 can comprise one of a variety of connecting mechanisms including threads or snaps. In alternate embodiments, the clevis may be disposed on top of the mounting base or in a recess of the mounting base, as opposed to within cavity 176. Alternate embodiments can arrange the clevis so that it is actuated indirectly by the actuator. Both the mounting base 140 and the clevis 180 are preferably made of light and resilient material such as a plastic material. The body of the clevis 180 can include apertures to further reduce its weight. As shown in FIG. 11, the clevis 180 can include a flat bottom surface which can be useful in testing the performance of the electrical apparatus or its components.

Similar to the protrusions on the mounting base 140, the clevis includes a first clevis protrusion 184, second clevis protrusion 185, third clevis protrusion 186, and fourth clevis protrusion 187. The first swing arm 165 can be mounted via slots on the second 185 and third 186 clevis protrusions and the second swing arm 166 can be mounted via slots on the first 184 and fourth 187 clevis protrusions. The arrangement of the swing arms 165 and 166 on the mounting base protrusions and the clevis protrusions causes the swing arms to swing when the clevis is moved axially (up or down in the orientation in the figures) by the actuator to which it is attached. Therefore, in a first position when the switch is opening, the actuator moves the clevis downward along a longitudinal axis running from the top of the interrupting module 105 through the drain hole 116. This downward motion causes the swing arms to swing so that the first and second bottom members 167 and 168 of the first and second swing arms 165 and 166 rotate outward and cover the first bottom wing display surface 150 and the second bottom wing display surface 155. With the first and second swing arms 165 and 166 rotated outward and covering the first and second bottom wing display surfaces 150 and 155, the indicators on the swing arms 165 and 166 will be visible through the viewing windows 120 and 121 when viewed from outside the apparatus. As described above in connection with FIGS. 3-7, the opaque walls of the window inserts 130 within the viewing windows 120 and 121 will obstruct the surrounding portions of the indicator so that only the indicators on the swing arms 165 and 166 will be visible when the swing arms rotate outward to cover the first bottom display surface 150 and the second bottom display surface 155. Alternatively, in a second position when the switch is closed, the actuator moves the clevis upward causing the swing arms to swing inward thereby exposing the first bottom wing display surface 150 and the second bottom wing display surface 155 through the viewing windows 120 and 121. In this second position, the opaque walls of the window inserts 130 within the viewing windows 120 and 121 will obstruct the swing arms 165 and 166 from view so that only the display surfaces of the first wing 145 and the second wing 146 are visible through the viewing windows 120 and 121.

The foregoing embodiments described in connection with FIGS. 1-13 comprise a status indicator with two swing arms and two viewing windows in order to increase the range of angles from which the status indicator can be seen. Alternate embodiments may comprise variations with respect to the components illustrated and described in connection with FIGS. 1-13. For example, the embodiment illustrated in FIGS. 8-11 could be modified so that the swing arms are positioned outside the wings and swing inward to cover the wings or the "closed" and "open" indicators could be reversed as between the wings and the swing arms. As another example, in alternate embodiments the shape of the lower cover, the viewing window, or the status indicator may have different forms including but not limited to circular, cylindrical, and square. In yet another alternate embodiment, the protrusions of the mounting base and the clevis can be replaced with a variety of other connection means such as pins or other fastening mechanisms.

Figure 14:
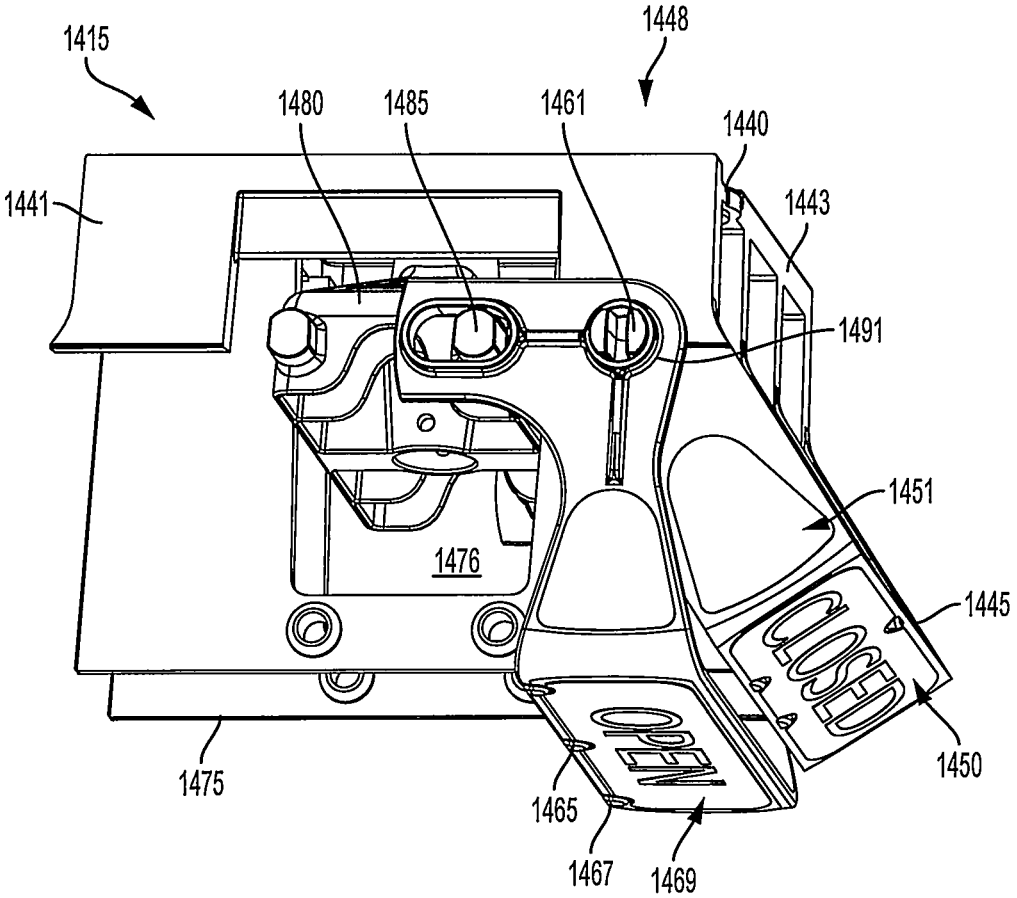
FIG. 14 illustrates an alternate embodiment of the status indicator comprising a single swing arm.

As another example, alternate embodiments of the disclosure may comprise only a single swing arm, a single wing, and a single viewing window as illustrated in FIG. 14. In the example status indicator 1415 shown in FIG. 14, many of the components are the same as or similar to the components described previously in connection with status indicator 115. Those components shown in FIG. 14 that are the same or similar to the components previously described in connection with status indicator 115 have the same last two digits as their reference numbers and a detailed description of the components will not be repeated. Briefly, the alternate example shown in FIG. 14 comprises a mounting base 1440 with a first side 1441, a second side opposite the first side, a third side 1443, and a fourth side opposite the third side. The mounting base 1440 further comprises one or more guide ribs 1475 and a cavity 1476 in which a clevis 1480 is disposed. The third side 1443 of the mounting base 1440 comprises a wing 1445 with a bottom wing display surface 1445 and optionally can include first side wing display surface 1451 and a second side wing display surface opposite the first side wing display surface 1451. The operation of status indicator 1415 is similar to the operation of status indicator 115 described above, except that status indicator 1415 only comprises a single swing arm 1465. The swing arm 1465 is similar to swing arm 165 in that it comprises bottom member 1467, bottom swing arm display surface 1469, side members, and optional side display surfaces. The swing arm 1465 is attached to the mounting base 1440 via first aperture 1491 placed onto first protrusion 1461 and a similar second aperture and second protrusion on the second side of the mounting base 1440. The swing arm 1465 is also attached to the clevis 1480 via a pair of slots that are placed onto first clevis protrusion 1485 and a second clevis protrusion on the opposite side of the clevis 1480. As with indicator 115, display surfaces on indicator 1415 can comprise one or more indicators in the form of words, symbols, and/or colors indicating a state of an electrical device. The surfaces and features on the sides of the mounting base 1440 that are not visible in FIG. 14 are similar to the surfaces and features previously shown and described in connection with mounting base 140 illustrated in FIGS. 8-11.

Figure 15:
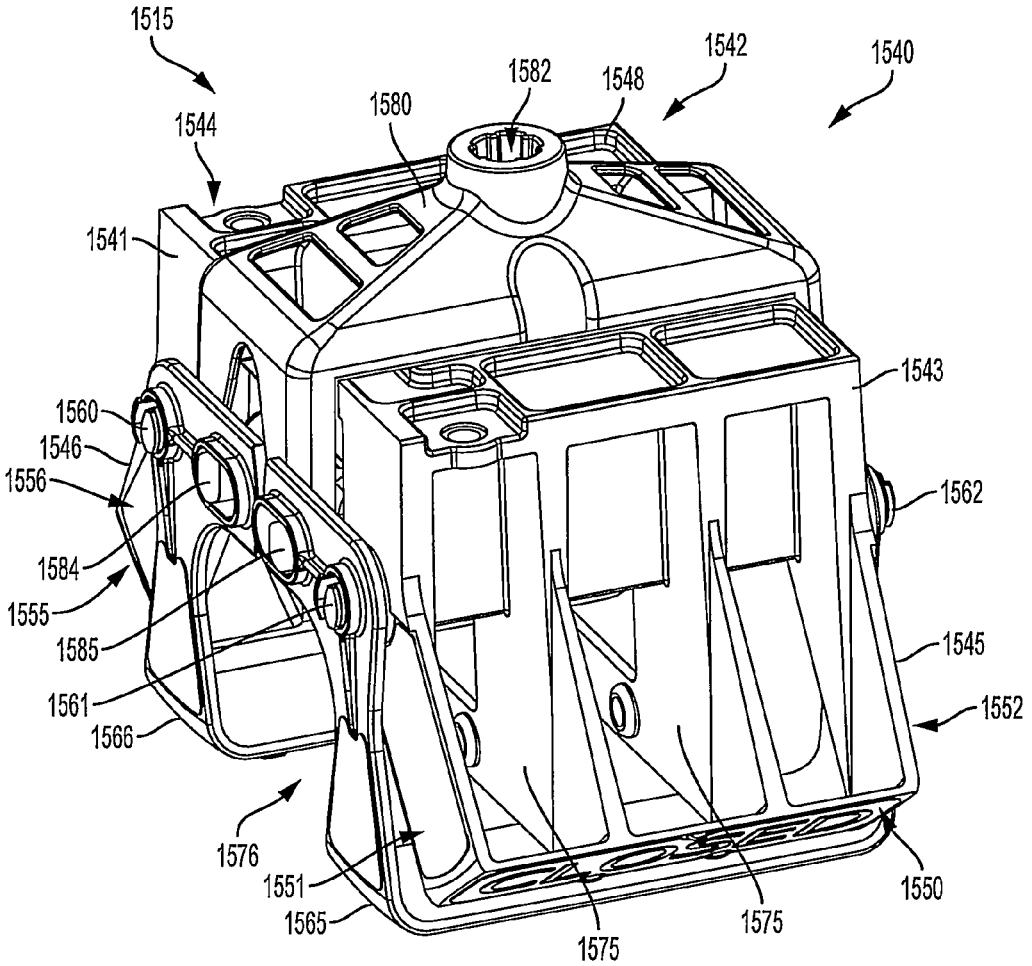
FIG. 15 illustrates yet another alternate embodiment of the status indicator with a yoke extending over the top of the mounting base.

In yet another alternate embodiment, the clevis can be replaced with a variety of other attachment means, such as a yoke attachment means, for interfacing between the status indicator and the actuator of the electrical apparatus. As illustrated in FIG. 15, a yoke can extend over the top of the mounting base instead of being positioned within the mounting base. In the example status indicator 1515 shown in FIG. 15, many of the components are the same as or similar to the components described previously in connection with status indicator 115. Those components shown in FIG. 15 that are the same or similar to the components previously described in connection with status indicator 115 have the same last two digits as their reference numbers and a detailed description of the components will not be repeated. As with indicator 115, display surfaces on indicator 1515 can comprise one or more indicators in the form of words, symbols, and/or colors indicating a state of an electrical device. The surfaces and features on the sides of the mounting base 1540 that are not visible in FIG. 15 are similar to the surfaces and features previously shown and described in connection with mounting base 140 illustrated in FIGS. 8-11. Likewise, the operation of status indicator 1515 is similar to the operation of status indicator 115 described above, except that the clevis 180 of status indicator 115 is replaced with the yoke 1580 of status indicator 1515.

Turning to a brief description of status indicator 1515, it comprises a mounting base 1540 with a first side 1541, a second side 1542, a third side 1543, a fourth side 1544, a top surface 1548, guide ribs 1575, and a cavity 1576. A first wing 1545 extends from the third side 1543 and a second wing 1546 extends from the fourth side 1544. The first wing 1545 comprises a first bottom wing display surface 1550 and optionally can include first side wing display surface 1551 and second side wing display surface 1552. Similarly, the second wing 1546 comprises a second bottom wing display surface 1555 and optionally can include third side wing display surface 1556 and a fourth side wing display surface that is opposite the third side wing display surface 1556. The status indicator 1515 further comprises a first swing arm 1565 and a second swing arm 1566, each of which comprise a pair of apertures and a pair of slots similar to the swing arms of status indicator 115. The apertures of the swing arms are attached to the mounting base 1540 via four mounting base connection means, such as first 1560, second 1561, third 1562, and fourth (not visible in FIG. 15) mounting base protrusions. Each swing arm also comprises a pair of slots attached to the yoke 1580 via four yoke connection means, such as first 1584, second 1585, third, and fourth yoke protrusions. Although not visible in FIG. 15, the third and fourth yoke protrusions are located on the opposite side from the first 1584 and second 1585 yoke protrusions. The yoke 1580 comprises a connection feature 1582 for connecting to an actuator of an electrical device, such as a recloser. Similar to the operation of status indicator 115, status indicator 1515 is activated by the actuator connected to the connection feature 1582 causing the yoke 1580 to move either up or down and causing the swing arms 1565 and 1566 to swing either inward or outward.

In conclusion, the example status indicators described herein provide improvements over conventional indicators by providing improved visibility from various angles. The example status indicators described herein are also less likely to malfunction or be adversely affected by condensation collecting inside the status indicator or precipitation collecting on the outside of the status indicator. It should be appreciated that aspects of the disclosure described above are by way of example only, and are not intended as required or essential elements of the disclosure unless explicitly stated otherwise. Although example embodiments are described herein, it should be appreciated by those skilled in the art that various modifications are well within the scope of this disclosure. From the description of the example embodiments, equivalents of the elements shown therein will suggest themselves to those skilled in the art. Those skilled in the art will appreciate that the present disclosure is not limited to any specifically discussed application and that the embodiments described herein are illustrative and not restrictive.

The invention claimed is:

1. A status indicator for a recloser, the status indicator comprising:

a mounting base, the mounting base comprising:

a first mounting base protrusion and a second mounting base protrusion extending from a first side of the mounting base;

a third mounting base protrusion and a fourth mounting base protrusion extending from a second side of the mounting base;

a first wing extending from a third side of the mounting base and comprising a first bottom wing display face and a second wing extending from a fourth side of the mounting base and comprising a second bottom wing display face;

a clevis disposed in an internal cavity of the mounting base, the clevis comprising:

a first clevis protrusion and a second clevis protrusion extending from a first side of the clevis;

a third clevis protrusion and a fourth clevis protrusion extending from a second side of the clevis, the second side opposite to the first side of the clevis; and a first swing arm and a second swing arm, each of the first and second swing arms comprising a bottom member and two side members, the bottom member comprising a bottom swing arm display face, each of the two side members comprising a slot and an aperture, the slots on the first swing arm positioned on the first and fourth clevis protrusions, the apertures on the first swing arm positioned on the first and fourth mounting base protrusions, the slots on the second swing arm positioned on the second and third clevis protrusions, and the apertures on the second swing arm positioned on the second and third mounting base protrusions.

2. The status indicator for the recloser of claim 1, wherein the clevis further comprises a feature for interfacing with an actuator of the recloser, the actuator of the recloser causing an axial motion of the clevis.

3. The status indicator for the recloser of claim 2, wherein the axial motion of the clevis causes the first swing arm and the second swing arm to rotate.

4. The status indicator for the recloser of claim 2, wherein the mounting base comprises top surface apertures on a top surface of the mounting base, the top surface apertures for attaching the status indicator to the actuator of the recloser.

5. The status indicator for the recloser of claim 1, wherein the first wing and the second wing further comprise one or more side wing display faces.

6. The status indicator for the recloser of claim 1, wherein indicators are placed on the respective first and second bottom wing display faces of the first and second wings and the bottom swing arm display faces of the first and second swing arms.

7. The status indicator for the recloser of claim 6, wherein the indicators comprise reflective material.

8. The status indicator for the recloser of claim 1, wherein in a first position the bottom swing arm display faces of the first and second swing arms cover the respective first and second bottom wing display faces of the first and second wings and in a second position the bottom swing arm display faces of the first and second swing arms do not cover the respective bottom wing display faces of the first and second wings.

9. The status indicator for the recloser of claim 1, wherein the status indicator is enclosed within a lower cover, the lower cover comprising at least two viewing windows that are above a lowest point of the lower cover.

10. The status indicator for the recloser of claim 9, wherein the at least two viewing windows are on opposite sides of the lowest point of the lower cover.

11. The status indicator for the recloser of claim 9, wherein in a first position the bottom swing arm display faces of the first and second swing arms are visible through the at least two viewing windows and in a second position the bottom wing display faces of the first and second wings are visible through the at least two viewing windows.

12. A status indicator for an electrical device, the status indicator comprising:

a mounting base, the mounting base comprising:

a first mounting base protrusion and a second mounting base protrusion, the first and second mounting base protrusions extending from opposite sides of the mounting base, and at least one wing, the wing comprising a bottom wing display face;

a clevis disposed in the mounting base, the clevis comprising a first clevis protrusion and a second clevis protrusion, the first and second clevis protrusions extending from opposite sides of the clevis; and a swing arm, the swing arm comprising a bottom member and two side members, the bottom member comprising a bottom swing arm display face, each of the two side members comprising a slot and an aperture, the slots on the swing arm positioned on the first and second clevis protrusions, the apertures on the swing arm positioned on the first and second mounting base protrusions.

13. The status indicator for the recloser of claim 12, wherein the clevis further comprises a connection feature for connecting to an actuator of the recloser, the actuator of the recloser causing an axial motion of the clevis, the axial motion of the clevis causing the swing arm to rotate.

14. The status indicator for the recloser of claim 13, wherein the mounting base comprises top surface apertures on a top surface of the mounting base, the top surface apertures for attaching the status indicator to the actuator of the recloser.

15. The status indicator for the recloser of claim 12, wherein the wing further comprises side wing display faces.

16. The status indicator for the recloser of claim 12, wherein indicators are placed on the bottom wing display face of the wing and the bottom swing arm display face of the swing arm.

17. The status indicator for the recloser of claim 12, wherein in a first position the bottom swing arm display face of the swing arm covers the bottom wing display face of the wing and in a second position the bottom swing arm display face of the swing arm does not cover the bottom wing display face of the wing.

18. The status indicator for the recloser of claim 12, wherein the status indicator is enclosed within a lower cover, the lower cover comprising at least one viewing window that is offset from a lowest point of the lower cover; and wherein in a first position the bottom swing arm display face of the swing arm is visible through the at least one viewing window and in a second position the bottom wing display face of the at least one wing is visible through the at least one viewing window.

19. The status indicator for the recloser of claim 18, wherein a drip shed borders the at least one viewing window to inhibit precipitation from collecting on the at least one viewing window.

20. A status indicator for an electrical device, the status indicator comprising:

a mounting base, the mounting base comprising:

a first mounting base connection means and a second mounting base connection means extending from a first side of the mounting base;

a third mounting base connection means and a fourth mounting base connection means extending from a second side of the mounting base;

a first wing extending from a third side of the mounting base and comprising a first bottom wing display face and a second wing extending from a fourth side of the mounting base and comprising a second bottom wing display face;

a yoke attachment means disposed around the mounting base, the yoke attachment means comprising a first yoke connection means, a second yoke connection means, a third yoke connection means, and a fourth yoke connection means;

a first swing arm and a second swing arm, each of the first and second swing arms comprising a bottom member and two side members, the bottom member comprising a bottom swing arm display face, wherein the first swing arm is attached to the first mounting base connection means, the fourth mounting base connection means, the first yoke connection means, and the fourth yoke connection means, and the second swing arm is attached to the second mounting base connection means, the third mounting base connection means, the second yoke connection means, and the third yoke connection means.

* * * * *